US008337142B2

(12) United States Patent
Eslinger et al.

(10) Patent No.: US 8,337,142 B2
(45) Date of Patent: Dec. 25, 2012

(54) SYSTEM AND METHOD FOR REDUCING THRUST ACTING ON SUBMERSIBLE PUMPING COMPONENTS

(75) Inventors: David M. Eslinger, Collinsville, OK (US); Matthew R. Hackworth, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 15 days.

(21) Appl. No.: 12/612,041

(22) Filed: Nov. 4, 2009

(65) Prior Publication Data

US 2010/0040492 A1 Feb. 18, 2010

Related U.S. Application Data

(60) Division of application No. 11/468,565, filed on Aug. 30, 2006, now Pat. No. 7,648,332, which is a continuation of application No. 11/468,511, filed on Aug. 30, 2006.

(51) Int. Cl.
*F04D 29/051* (2006.01)

(52) U.S. Cl. ..... 415/104; 415/111; 415/107; 415/199.1; 415/1; 417/365; 417/423.3; 417/424.2

(58) Field of Classification Search ..... 415/99, 415/100, 106, 107, 115, 104, 199.1, 144, 415/111, 112; 417/365, 423.3, 424.2
See application file for complete search history.

(56) References Cited

U.S. PATENT DOCUMENTS

| | | | | | |
|---|---|---|---|---|---|
| 1,037,243 | A | | 9/1912 | Guy | |
| 1,369,508 | A | | 2/1921 | Weiner et al. | |
| 1,483,645 | A | | 2/1924 | Sessions | |
| 1,609,306 | A | * | 12/1926 | Peterson | 417/406 |
| 1,667,992 | A | | 5/1928 | Scherwood et al. | |
| 2,809,590 | A | * | 10/1957 | Brown | 417/357 |
| 3,058,510 | A | * | 10/1962 | Tiraspolsky et al. | 415/107 |
| 3,265,001 | A | | 8/1966 | Deters | |
| 3,874,812 | A | * | 4/1975 | Hanagarth | 415/106 |
| 3,975,117 | A | * | 8/1976 | Carter | 417/370 |
| 4,363,608 | A | | 12/1982 | Mulders | |
| 4,678,399 | A | | 7/1987 | Vandevier et al. | |
| 4,838,758 | A | | 6/1989 | Sheth | |
| 5,133,639 | A | | 7/1992 | Gay et al. | |
| 5,201,848 | A | * | 4/1993 | Powers | 415/199.1 |
| 5,667,314 | A | | 9/1997 | Limanowka et al. | |
| 5,690,471 | A | | 11/1997 | Sasaki | |
| 5,722,812 | A | | 3/1998 | Knox et al. | |
| 5,961,282 | A | * | 10/1999 | Wittrisch et al. | 415/199.6 |
| 6,068,444 | A | | 5/2000 | Sheth | |
| 6,106,224 | A | | 8/2000 | Sheth et al. | |

FOREIGN PATENT DOCUMENTS

| | | |
|---|---|---|
| EP | 0078345 | 5/1983 |
| GB | 2339851 A | 2/2000 |

* cited by examiner

*Primary Examiner* — Ninh H Nguyen
(74) *Attorney, Agent, or Firm* — Jim Patterson

(57) ABSTRACT

A technique is provided to facilitate pumping of fluids in a well environment. A submersible pumping system having a submersible pump incorporates features that manage thrust loads resulting from rotating impellers. The thrust reducing features cooperate with the action of the impellers in one or more pump stages to reduce forces otherwise acting on certain pump related components.

9 Claims, 5 Drawing Sheets

SYSTEM AND METHOD FOR REDUCING THRUST ACTING ON SUBMERSIBLE PUMPING COMPONENTS

CROSS REFERENCE TO RELATED APPLICATION

This application is a divisional of U.S. patent application Ser. No. 11/468,565, filed Aug. 30, 2006, which is a continuation of U.S. patent application Ser. No. 11/468,511, entitled "System and Method for Reducing Thrust Acting On Submersible Pumping Components", filed Aug. 30, 2006, and is hereby incorporated by reference in its entirety.

BACKGROUND

When pumping downhole fluids with an electric submersible pump, a variety of hydraulic forces act on various components. For example, impellers in centrifugal, submersible pumps tend to create large reaction forces that act in a direction opposite to the direction of fluid flow. The large reaction forces are resisted by, for example, a thrust washer in each stage of a floater style pump or by a motor protector thrust bearing in a compression style pump.

The thrust created by the impeller in each stage of a submersible pump can be problematic in a variety of submersible pump types, including pumps with mixed flow stages and pumps with radial flow stages. In some floater style designs, for example, a significant portion of power loss in the pump is due to thrust friction occurring at the outer thrust washer due to relatively high friction induced torque at this radially outlying position. If the outer thrust washer is removed from the floater style stage, however, the lack of any seal functionality increases leakage loss.

SUMMARY

In general, the present invention provides a technique for pumping fluids in a submerged environment. The technique is useful with submersible pumping systems, such as those used in wellbore applications for pumping downhole fluids. A submersible pumping system is designed to utilize thrust control features with the submersible pump to reduce certain thrust loads otherwise acting on submersible pump components.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for reducing certain effects of thrust loads created while pumping fluids. For example, the system and methodology can be used in submersible pumping systems having centrifugal style, submersible pumps. One or more features are incorporated into the submersible pumping system to manage the hydraulic forces acting on external surfaces of the pump impellers that tend to create large reaction forces acting opposite to the flow direction of the pumped fluid.

Figure 1:
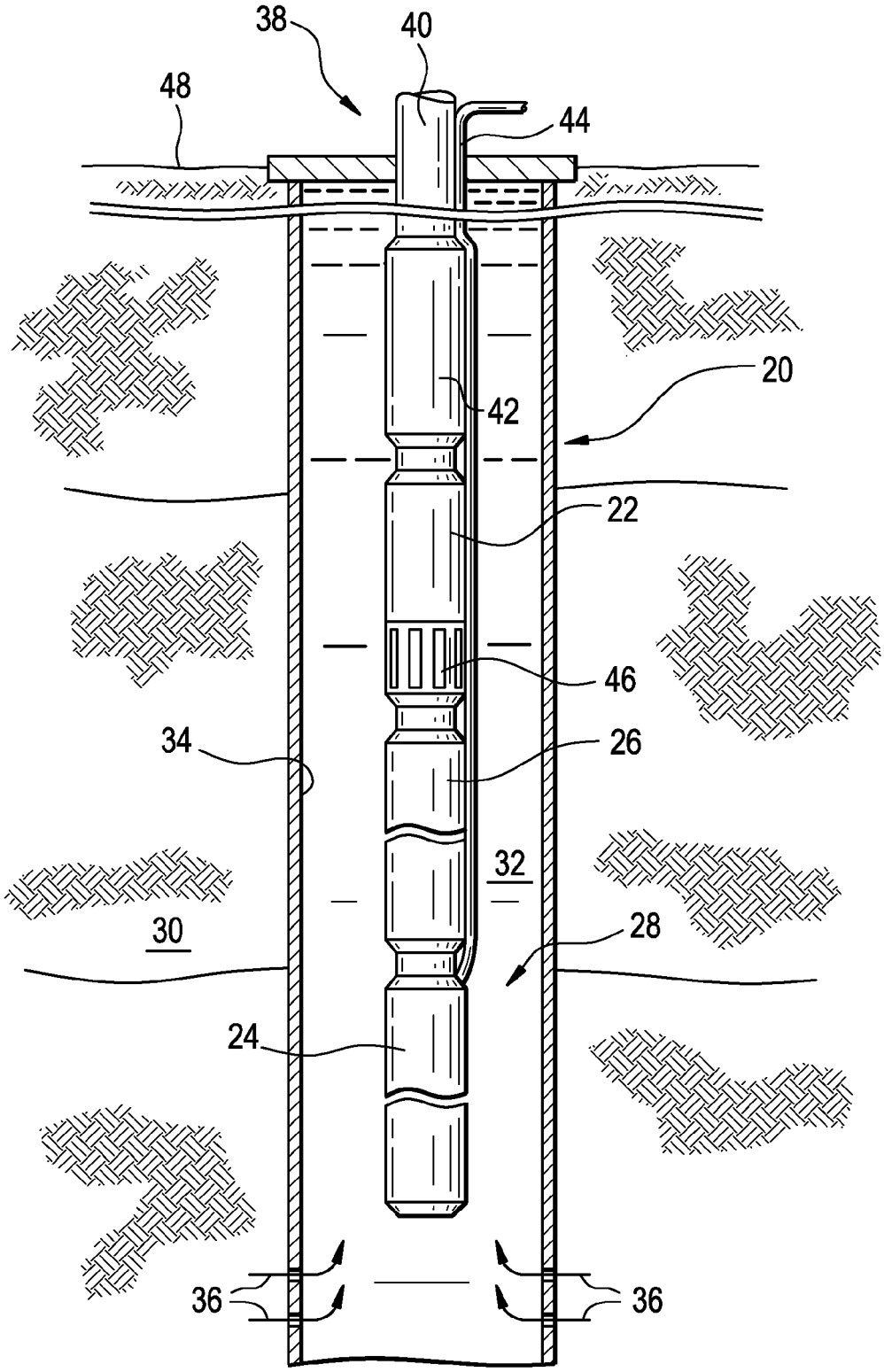
FIG. 1 is an elevation view of an embodiment of an electric submersible pumping system deployed in a wellbore, according to an embodiment of the present invention.

Referring generally to FIG. 1, an embodiment of a submersible pumping system 20, such as an electric submersible pumping system, is illustrated. Submersible pumping system 20 may comprise a variety of components depending on the particular application or environment in which it is used. Examples of components utilized in pumping system 20 comprise at least one submersible pump 22, at least one submersible motor 24, and one or more motor protectors 26 that are coupled together to form the submersible pumping system.

In the example illustrated, submersible pumping system 20 is designed for deployment in a well 28 within a geological formation 30 containing desirable production fluids, such as petroleum. A wellbore 32 is drilled into formation 30, and, in at least some applications, is lined with a wellbore casing 34. Perforations 36 are formed through wellbore casing 34 to enable flow of fluids between the surrounding formation 30 and the wellbore 32.

Submersible pumping system 20 is deployed in wellbore 32 by a deployment system 38 that may have a variety of configurations. For example, deployment system 38 may comprise tubing 40, such as coiled tubing or production tubing, connected to submersible pump 22 by a connector 42. Power is provided to the at least one submersible motor 24 via a power cable 44. The submersible motor 24, in turn, powers submersible pump 22 which can be used to draw in production fluid through a pump intake 46. Within submersible pump 22, a plurality of impellers is rotated to pump or produce the production fluid through, for example, tubing 40 to a desired collection location which may be at a surface 48 of the Earth.

It should be noted the illustrated submersible pumping system 20 is only one example of many types of submersible pumping systems that can benefit from the features described herein. For example, other components can be added to the pumping system, and other deployment systems may be used. Additionally, the production fluids may be pumped to the collection location through tubing 40 or through the annulus around deployment system 38. The submersible pump or pumps 22 also can utilize different types of stages, such as mixed flow stages or radial flow stages.

Figure 2:
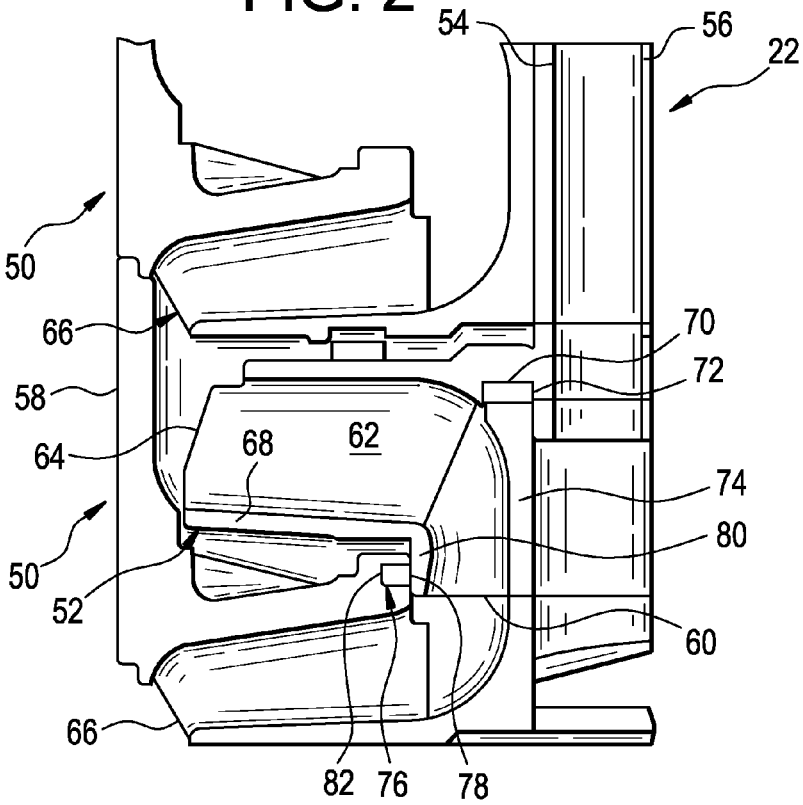
FIG. 2 is a partial cross-sectional view of an embodiment of the submersible pump illustrated in FIG. 1, according to an embodiment of the present invention.

Referring generally to FIG. 2, a cross-sectional view is provided of a portion of one embodiment of submersible pump 22. In this embodiment, submersible pump 22 comprises a plurality of stages 50. Each stage 50 comprises an impeller 52 coupled to a shaft 54 rotatable about a central axis 56. Rotation of shaft 54 by submersible motor 24 causes impellers 52 to rotate within an outer pump housing 58. Each impeller 52 draws fluid in through an impeller or stage intake 60 and routes the fluid along an interior impeller passageway 62 before discharging the fluid through an impeller outlet 64 and into an axially adjacent diffuser 66. The interior passageway 62 is defined by the shape of an impeller housing 68, and housing 68 may be formed to create an impeller for a floater stage, as illustrated in FIG. 2, or for a compression stage (see FIG. 6). Additionally, impeller housing 68 may be designed to create a mixed flow stage, a radial flow stage, or another suitable stage style for use in submersible pump 22.

In the embodiment illustrated in FIG. 2, an inner thrust member 70, such as an inner thrust washer, is positioned to resist thrust loads, e.g. downthrust loads, created by the rotating impeller 52. In this embodiment, inner thrust washer 70 is positioned in an impeller feature 72, such as a recess formed in an upper portion of impeller housing 68. The inner thrust washer 70 is disposed between the impeller 52 and a radially inward portion 74 of the next adjacent upstream diffuser 66. Instead of a conventional outer thrust washer, however, an axially compliant outer seal member 76 is used. In the embodiment of FIG. 2, seal member 76 comprises a radial seal 78 positioned in sealing engagement with a generally axially oriented section 80 of impeller housing 68. Thus, the seal member 76 forms a sealing point with section 80 of impeller 52, and the sealing point is translatable axially along section 80. The radial seal 78 may be positioned within a recess 82 formed in a portion of the adjacent diffuser 66, as illustrated. Accordingly, an outer seal is formed between the impeller and the adjacent diffuser without the creation of unwanted reaction forces on radially outward surfaces within submersible pump 22.

Figure 3:
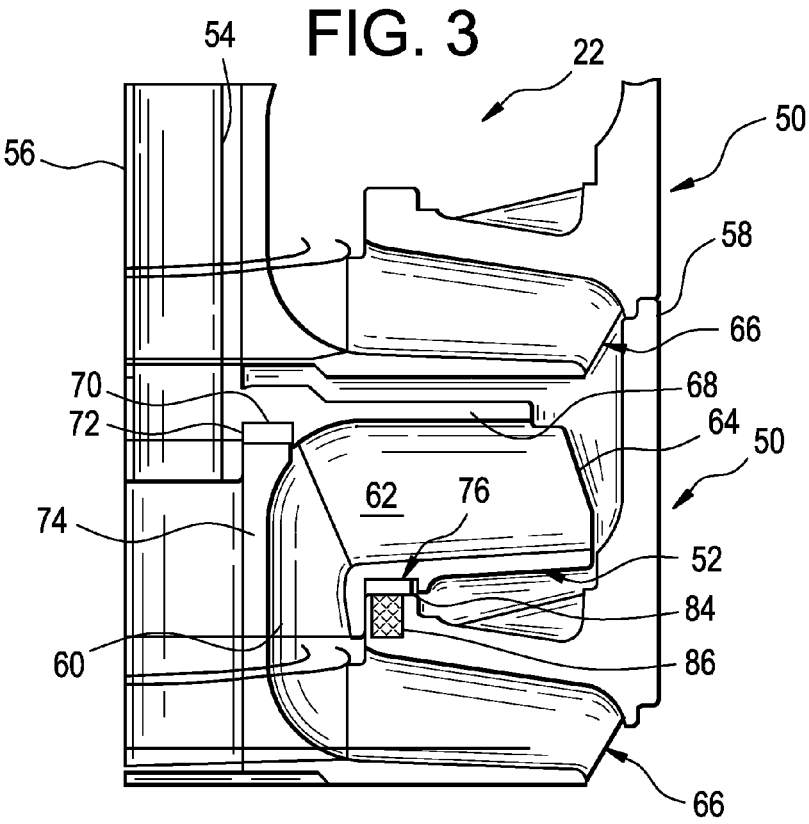
FIG. 3 is a partial cross-sectional view of another embodiment of the submersible pump illustrated in FIG. 1, according to an embodiment of the present invention.

An alternate embodiment of seal member 76 is illustrated in FIG. 3. In this embodiment, inner thrust member 70 is similarly positioned at a radially inward position. However, seal member 76 comprises a radially outlying member 84, such as an outer washer, supported by an axially compliant member 86. The axially compliant member 86 enables translation of seal member 76 in a generally axial direction by virtue of the compression and expansion of member 86. By way of example, axially compliant member 86 may comprise a spring member or other type of compliant member made from a variety of materials, including metallic materials, elastomeric materials and composite materials. It should be noted the embodiment illustrated in FIGS. 2 and 3 also can be used with compression stages to eliminate front seal leakage.

Figure 4:
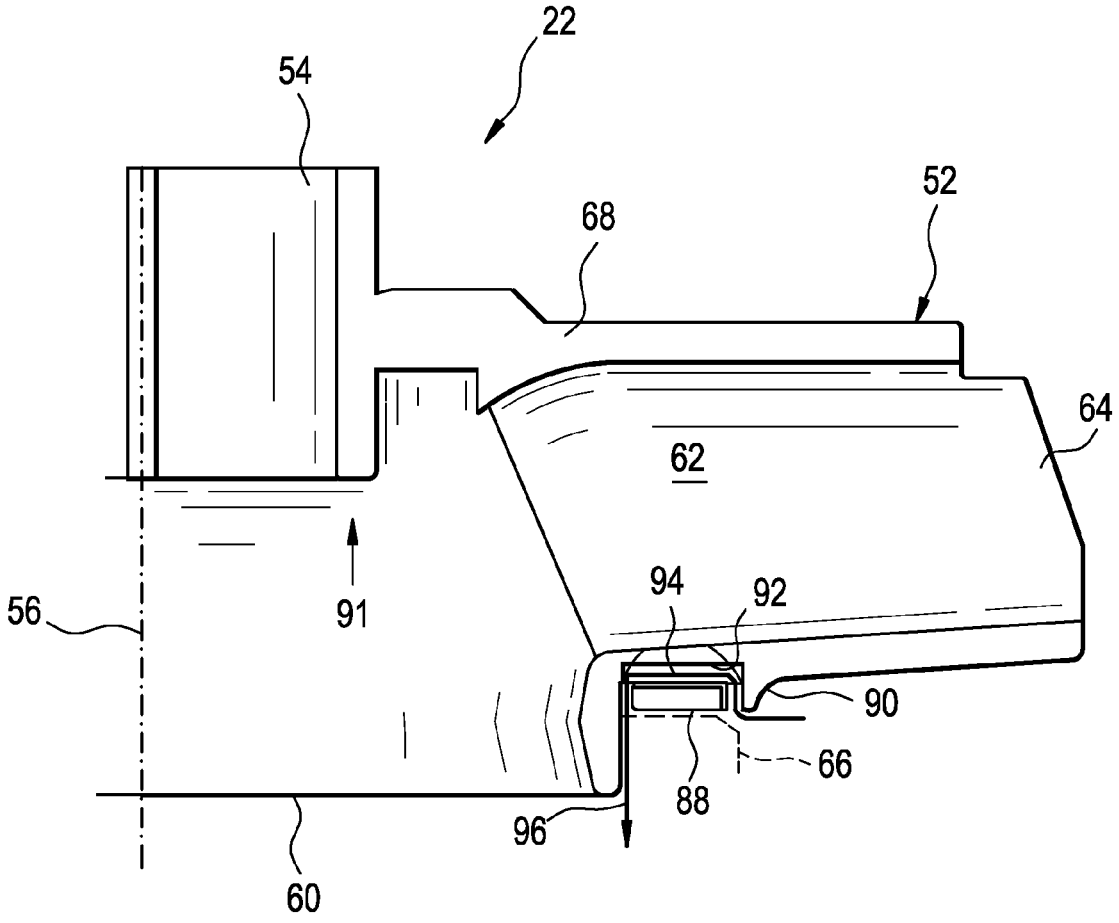
FIG. 4 is a partial cross-sectional view of another embodiment of the submersible pump illustrated in FIG. 1, according to an embodiment of the present invention.

In another embodiment of the system for managing thrust loads, the net thrust load, e.g. net downthrust load, can be reduced by pressure balancing a thrust washer area so the impeller discharge pressure rather than the impeller inlet pressure acts on the thrust washer. In this embodiment, a flow passage is formed across a thrust member 88 to pressure balance the thrust member 88. The flow passage can be routed, for example, between the thrust member 88 and the impeller 52 or between the thrust member 88 and a thrust pad of the adjacent diffuser. In one example, the thrust member 88, e.g. a thrust washer, is held in a retaining feature 90 of impeller 52 at a position located radially outward of an eye 91 of the impeller, as illustrated in FIG. 4. The retaining feature 90 may comprise a groove 92 formed in a lower portion of the impeller 52. A flow passage 94 is routed along a backside of thrust member 88 between thrust member 88 and impeller 52, as illustrated by arrow 96 in FIG. 4. The flow path or passage 94 creates a flow of fluid during operation of submersible pump 22 which decreases the thrust load acting on the thrust member 88. Alternatively, flow passage 94 can be formed between thrust member 88 and the adjacent diffuser 66 (see dashed lines in FIG. 4). For example, flow can be directed along radial grooves formed across the thrust member 88 and/or the adjacent diffuser 66 to decrease the thrust load acting on thrust member 88.

The flow passage 94 may be created by a variety of techniques, including spot facing impeller 52 at several locations in the retaining feature region to create the passage behind thrust member 88. The thrust member 88 may be press fit into retaining feature 90 to secure the thrust member at a location that forms the desired flow passage 94. In this embodiment, the net thrust reducing flow is directed from a radially outward region of thrust member 88, along the backside of thrust member 88, and out along a radially inward region of thrust member 88. In some embodiments, the flow of fluid through flow passage 94 is expelled out through a gap between a washer bore and an outside diameter of an impeller front seal. It should be noted that the flow resistance of the balance flow passage 94 should be less than the flow resistance of the front seal gap in each stage.

Figure 5:
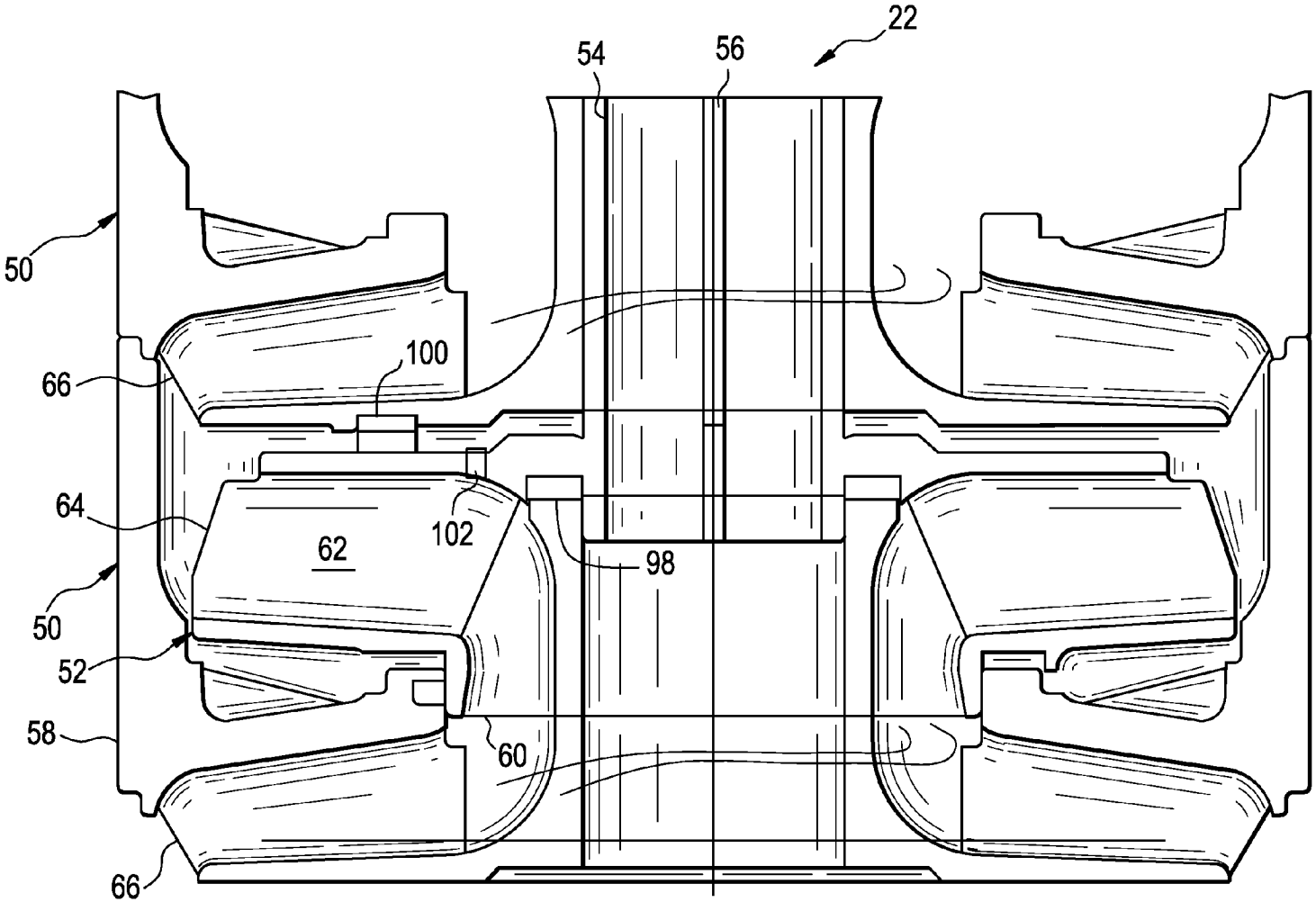
FIG. 5 is a partial cross-sectional view of another embodiment of the submersible pump illustrated in FIG. 1, according to an embodiment of the present invention.

Another embodiment of the system and methodology for pumping fluids and managing thrust loads is illustrated in FIG. 5. In this embodiment, the net downthrust load acting on a downthrust member 98 is reduced. Downthrust member 98 may comprise a downthrust pad or thrust washer and may be located at a radially inward position, as illustrated. The downthrust acting on member 98 is reduced by incorporating an upper thrust member 100, such as an upper thrust pad or washer. Additionally, one or more balance holes 102 are positioned to allow leakage of fluid from interior passage 62 of impeller 52 and across upper thrust member 100. In the embodiment illustrated, balance holes 102 are formed through an upper portion of impeller housing 68 above the interior passage 62, and they are oriented in a generally axial direction. However, the positioning and orientation of balance holes 102 can be adjusted as desired for specific applications.

At start up of submersible pump 22, the impeller 52 of each stage 50 rests on its downthrust member 98. After startup, impellers 52 rotate and a leakage flow is induced by the discharge of each impeller 52 across upper the thrust member 100 and through balance hole(s) 102. This leakage flow reduces the pressure in the cavity between thrust members 98 and 100, causing the impeller 52 to shift upwardly and to contact the upper thrust member 100. The face seal formed by the upper thrust member 100 also seals off leakage flow through the balance holes 102. Accordingly, this configuration provides an improved axial balance because the top area of impeller 52 that is located radially inward of upper thrust member 100 is exposed to impeller inlet pressure rather than impeller discharge pressure. Also, the embodiment illustrated in FIG. 5 may utilize seal member 76 to facilitate sealed, axial movement of impeller 52. For example, seal member 76 may comprise radial seal 78 which allows axial translation of the impeller while maintaining a seal between the impeller and an adjacent diffuser. The embodiment illustrated in FIG. 5 is particularly applicable to radial flow stages and enables the stages to have a compact stage height relative to conventional designs.

Figure 6:
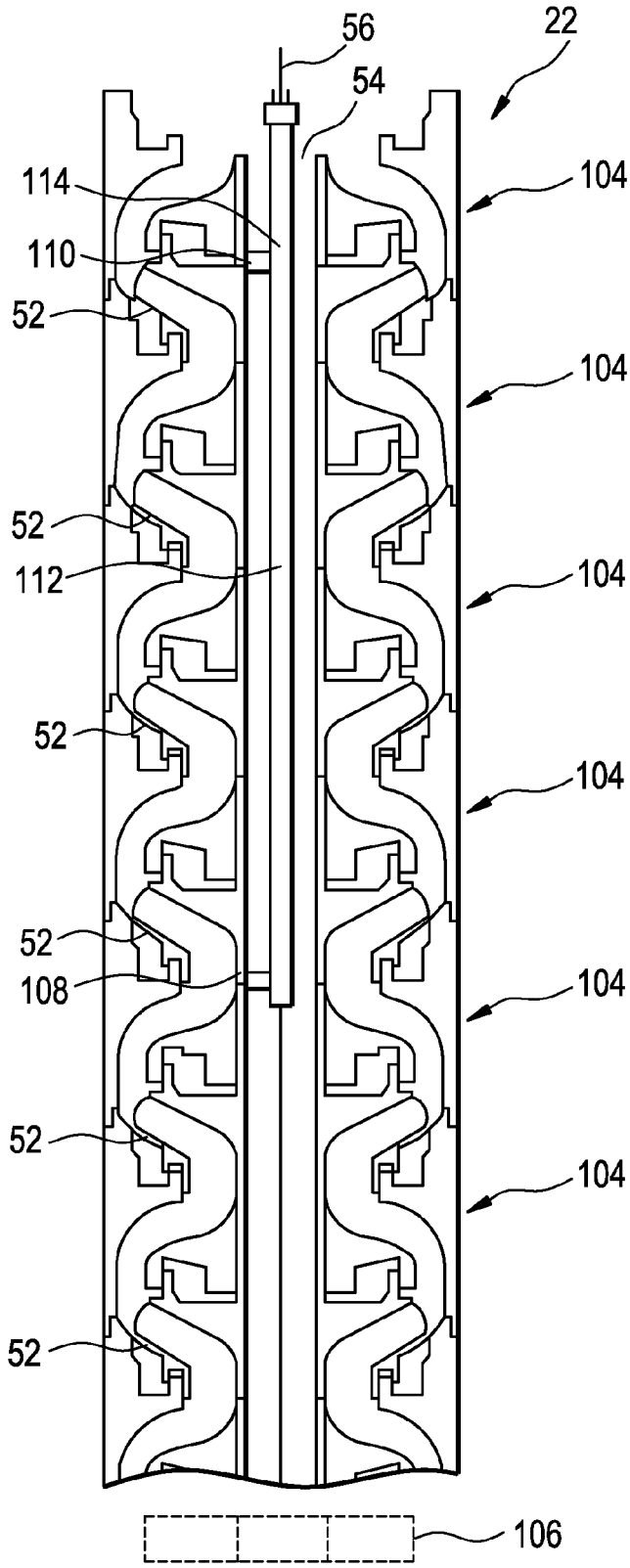
FIG. 6 is a partial cross-sectional view of another embodiment of the submersible pump illustrated in FIG. 1, according to an embodiment of the present invention.

Referring generally to FIG. 6, another embodiment of the system and methodology for pumping fluids and managing thrust loads is illustrated. In this embodiment, submersible pump 22 of submersible pumping system 20 is formed with a plurality of stacked, compression stages 104 having impellers 52 rotated by shaft 54. With compression stages 104, the net thrust load, e.g. downthrust load, resulting from rotation of impellers 52 is resisted by a protector bearing 106 (illustrated schematically in dashed lines) located in motor protector 26.

The thrust load on protector bearing 106 is reduced by effectively porting pressure from an inlet 108 of a lower or upstream stage 104 to a balance chamber 110 of an upper or downstream stage 104. In some embodiments, the upper/downstream stage 104 is the topmost stage, and the lower/upstream stage 104 is a lower or lowermost stage 104 in submersible pump 22. In other embodiments, the system can be designed such that the inlet 108 is the inlet of the submersible pump.

The pressure may be ported by creating a pressure relief path or fluid passageway 112 from the selected stage inlet 108 to the selected balance chamber 110. In one embodiment, passageway 112 is routed at least partially through shaft 54, and the passageway may be routed generally along a central axis of shaft 54. Additionally, an orifice 114 or other restrictor may be located in the passageway 112 to control the leakage flow rate from the upper/downstream stage 104 to the lower/upstream stage 104.

Specific components used in submersible pumping system 20 can vary depending on the actual well application in which the system is used. The specific components, component size and component location for managing net thrust loads also can vary from one submersible pumping system to another and from one well application to another. The specific embodiment utilized for controlling the thrust loads acting on certain components within the submersible pumping system is selected based on a variety of factors, e.g. the number and arrangement of submersible pumps, submersible motors, and motor protectors as well as the specific well environment, well application and production requirements. Other components can be attached to, or formed as part of, the electric submersible pumping system.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for pumping fluid, comprising:

an electric submersible pumping system comprising a submersible pump, a submersible motor, and a motor protector positioned between the submersible pump and the submersible motor, the motor protector comprising a protector bearing and the submersible pump comprising a plurality of compression stages that create a thrust load on the protector bearing when operated;

the submersible pump further comprising a fluid path contained within the plurality of compression stages and routed from an inlet positioned at a lower location of the submersible pump to a balance chamber of an upper stage, the fluid path being routed in a manner that allows fluid flow along the fluid path to reduce the thrust load acting on the protector bearing, the fluid path having an orifice sized to control a leakage flow rate from the upper stage to an inlet of a lower stage.

2. The system as recited in claim 1, wherein the fluid path is routed along a port formed in a shaft of the submersible pump.

3. The system as recited in claim 2, wherein the port formed in the shaft extends axially along a center of the shaft.

4. The system as recited in claim 1, wherein the upper stage comprises a top stage.

5. The system as recited in claim 1, wherein each compression stage comprises an impeller and a diffuser.

6. A method for managing thrust loads in a submersible pumping system, comprising:

coupling a submersible pump, a motor protector and a submersible motor to form a submersible pumping system in which the submersible motor is separated from the submersible pump by the motor protector;

locating a bearing in the motor protector to counteract thrust created by a plurality of impellers located in a corresponding plurality of submersible pump stages within the submersible pump;

routing a fluid passageway within the plurality of impellers from a lower inlet of a lower stage to a balance chamber of an upper stage such that fluid flow along the fluid passageway reduces thrust load on the bearing; and controlling a leakage flow rate along the fluid passageway.

7. The method as recited in claim 6, wherein routing comprises routing the fluid passageway from the inlet of a lowermost stage to the balance chamber of a top stage.

8. The method as recited in claim 7, wherein routing comprises routing at least a portion of the fluid passageway through a shaft of the submersible pump.

9. The method as recited in claim 6, wherein routing comprises routing at least a portion of the fluid passageway along an axis of a shaft of the submersible pump.

* * * * *